US005187489A

United States Patent [19]

Whelan et al.

[11] Patent Number: 5,187,489

[45] Date of Patent: Feb. 16, 1993

[54] ASYMMETRICALLY FLARED NOTCH RADIATOR

[75] Inventors: David A. Whelan, Chatsworth; John Fraschilla, Redondo Beach, both of Calif.

[73] Assignee: Hughes Aircraft Company, Los Angeles, Calif.

[21] Appl. No.: 751,241

[22] Filed: Aug. 26, 1991

[51] Int. Cl.[5] ..... H01Q 13/10

[52] U.S. Cl. ..... 343/767; 343/770

[58] Field of Search ..... 343/767, 770

[56] References Cited

U.S. PATENT DOCUMENTS

| | | | |
|---|---|---|---|
| 2,852,775 | 9/1958 | Zisler et al. | 343/767 |
| 4,509,053 | 4/1985 | Robin et al. | 343/767 |
| 5,070,340 | 12/1991 | Diaz | 343/767 |

*Primary Examiner*—John D. Lee
*Assistant Examiner*—Robert E. Wise
*Attorney, Agent, or Firm*—L. A. Alkov; W. K. Denson-Low

[57] ABSTRACT

An asymmetrical notch radiating element comprising a metal or metal-clad dielectric substrate into which a tapered slot or notch is disposed. The direction of the axis of the tapered slot lies along any preselected axis and is not constrained to be collinear with the normal to the aperture of the element. An asymmetrical antenna array comprises a plurality of asymmetrical notch radiating elements as described above. Each of the plurality of radiating elements is disposed such that the apertures of each of the elements are substantially coplanar and are at an angle relative to the notch axis. The present antenna uses asymmetric slot lines to control the antenna's electrical performance. The precise slot dimensions are chosen to optimize radiation and reduce scattering. The asymmetric flared notch allows optimization of the transmit gain in a direction that is not necessarily normal to the array surface. The asymmetrical notch radiator is designed for use in phased array antennas where reduced radar cross section and wide bandwidth are essential, or in conformal arrays, where the surface normal and array axis are not collinear. The normally high specular radar reflection from the antenna radiators, that lies along the array normal, no longer points in the same direction as the peak antenna gain. This allows the design of a low radar cross section array antenna that does not suffer poor gain due to its reduced cross section.

6 Claims, 2 Drawing Sheets

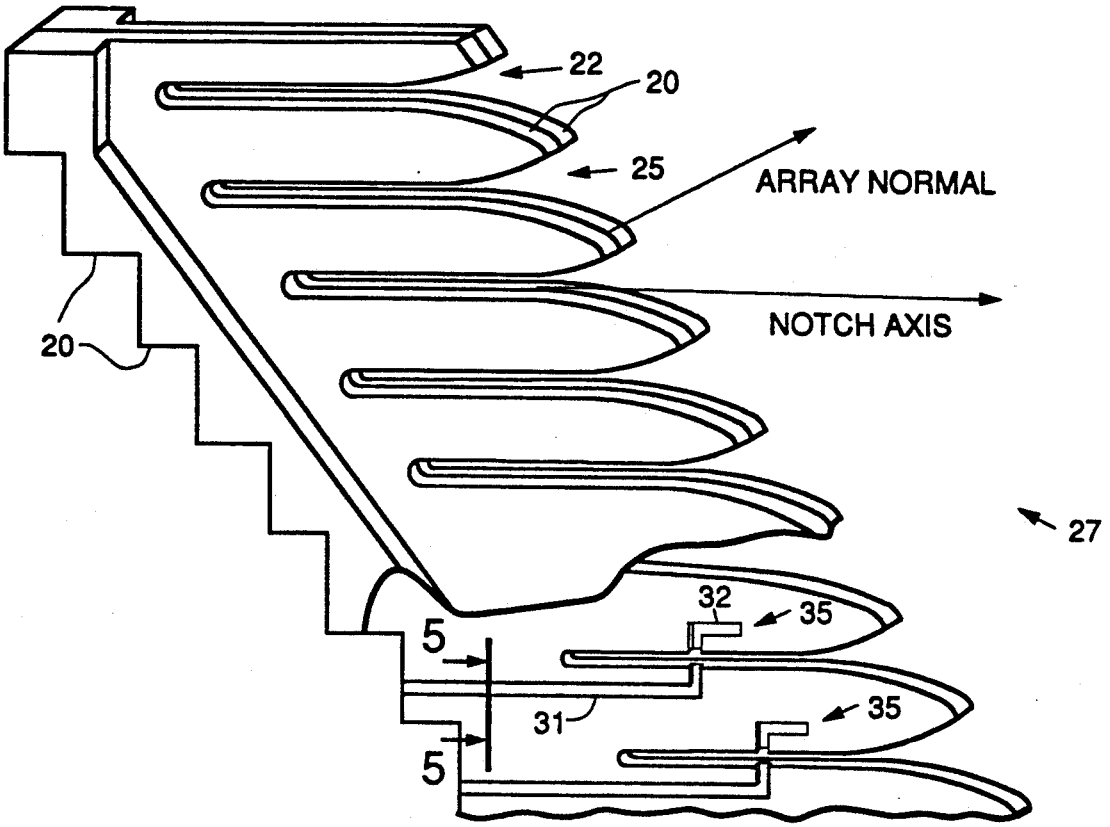
FIG. 4.
FIG. 5.
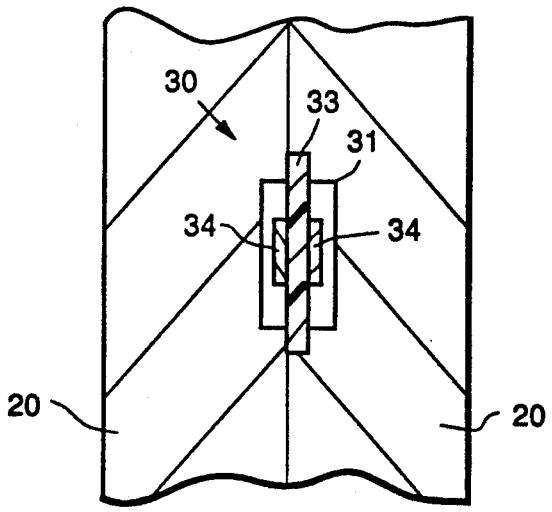

ASYMMETRICALLY FLARED NOTCH RADIATOR

BACKGROUND

The present invention relates generally to notch radiators, and more particularly, to asymmetrically flared notch radiator elements and asymmetrical antenna arrays incorporating such radiator elements for use in phased array antennas.

Conventional flared notch radiators are designed to have a peak antenna gain that lies along an axis normal to the array surface. In addition, specular scattering also occurs at an angle normal to the antenna aperture. Therefore it is impossible to have maximum gain and low radar cross section for a given threat window by simply rotating the array normal to the antenna aperture. It is not possible with a conventional flared notch radiator to have the maximum electric field intensity inside the notch to reside on an axis that is not parallel to the array normal. This property cannot be obtained using the conventional flared notch radiator. Another disadvantage of the conventional flared notch is that its planar geometry does not allow it to be mounted into curved surfaces.

Current and future airborne radars require a reduced radar cross section of its radiating aperture and, in order to detect reduced cross section targets, will require high gain apertures. In low radar cross section applications, conventional radiator elements suffer reduced gain at high angles of incidence, an effect which is compounded for systems using multiple radiators per feed port. Additional losses are encountered due to depolarization losses at high angles of incidence. Thus the competitive advantage of an antenna that does not suffer reduced gain while maintaining a reduced radar signature is very desirable. Future radar application, which envision conformal antenna arrays will need radiators for which the individual element patterns can be aligned in order to achieve good beam formation and low sidelobe control.

SUMMARY OF THE INVENTION

An asymmetrical notch radiating element in accordance with the present invention is comprised of a substrate into which a tapered slot or notch is cut. The direction of the axis of the tapered slot can be caused to lie along any preselected axis and is not constrained to be collinear with the normal to the aperture of the asymmetrical notch radiating element. The substrate may be made of metal or a metal-clad dielectric material, for example.

The tapered slot is disposed in the substrate and has a lower flare and an upper flare that form an aperture and that each extend from the aperture to a predetermined location within the radiating element where the lower and upper flares meet. The direction of an axis of the tapered slot lies along a preselected direction that is not collinear with the normal to the aperture of the asymmetrical notch radiating element.

An asymmetrical antenna array comprises a plurality of asymmetrical notch radiating elements as described above. Each of the plurality of asymmetrical notch radiating elements is disposed with respect to the other elements such that the apertures of each of the elements are substantially coplanar and are at an angle relative to the notch axis.

The present invention provides for a noel modification to a conventional flared notch radiator by making use of asymmetric slot lines to control the notch radiator electrical performance. The precise slot dimensions, which can be machined into a solid conductor or etched out of a cladded dielectric substrate, are chosen to optimize radiation and reduce scattering in a desired scan window.

The asymmetric flared notch of the present invention allows optimization of the transmit gain in a direction that is not necessarily normal to the array surface. The asymmetry causes the maximum electric field intensity inside the notch to reside on a axis that is not parallel to the array normal. Packaging of conformal arrays will also be easier with the added degree of freedom provided by a configurable radiator axis, and, as a consequence, the present invention can be mounted into curved surfaces.

The asymmetrical notch radiator is designed for use in phased array antennas where reduced radar cross section and wide bandwidth are essential, or in conformal arrays, where the surface normal and array axis are not collinear. The design is intended to allow the axis of maximum radiator element gain to lie along an axis other than the normal to the physical array face. The primary benefit of this approach is that the high specular radar reflection from the antenna radiators, that lies along the array normal, no longer points in the same direction as the peak antenna gain. This allows the design of a low radar cross section (RCS) array antenna that does not suffer poor gain due to its reduced cross section. The design is also beneficial in conformal array antennas, allowing the design freedom to mount radiator elements on an arbitrary surface, and still control the direction of peak gain of each element, thus allowing for alignment of all the element gain patterns.

BRIEF DESCRIPTION OF THE DRAWINGS

The various features and advantages of the present invention may be more readily understood with reference to the following detailed description taken in conjunction with the accompanying drawings, where like reference numerals designate like structural elements, and in which:

FIG. 4 shows an asymmetrical array of notch radiators made in accordance with the principles of the present invention.

FIG. 5 shows a cross-section at line 5—5 of the array of notch radiators shown in FIG. 4.

DETAILED DESCRIPTION

Figure 1:
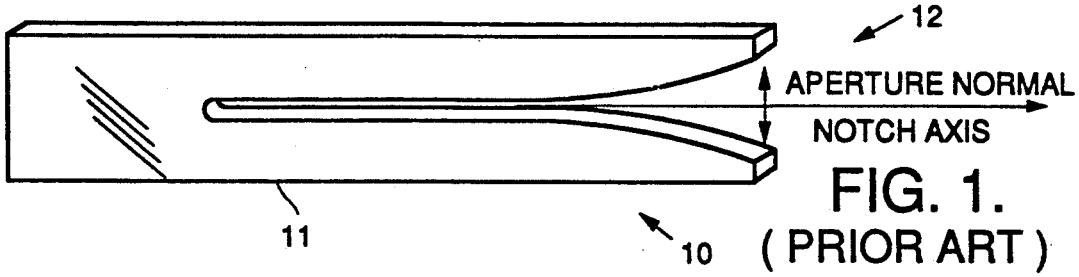
FIG. 1. ( PRIOR ART )
FIG. 1 shows a conventional notch radiator.

Referring to the drawing figures, FIG. 1 shows a conventional flared notch radiating element 10 over which the present invention is an improvement. The conventional flared notch radiating element 10 is comprised of a metal substrate 11 into which a symmetrical slot 12 or notch 12 is cut. The direction of the axis of the slot 12 lies along an axis that is collinear with an axis that is normal to the aperture of the radiating element 10.

The conventional flared notch radiating element 10 is designed to have a peak antenna gain that lies along an axis normal to its surface. Specular scattering also occurs at an angle normal to the radiator aperture. Therefore it is impossible to have maximum gain and low radar cross section for a given thread window by simply rotating the radiator. It is not possible with a conventional flared notch radiator to have the maximum electric field intensity inside the notch 12 to reside on an axis that is not parallel to the array normal. This property cannot be obtained using the conventional flared notch radiating element 10.

Figure 2:
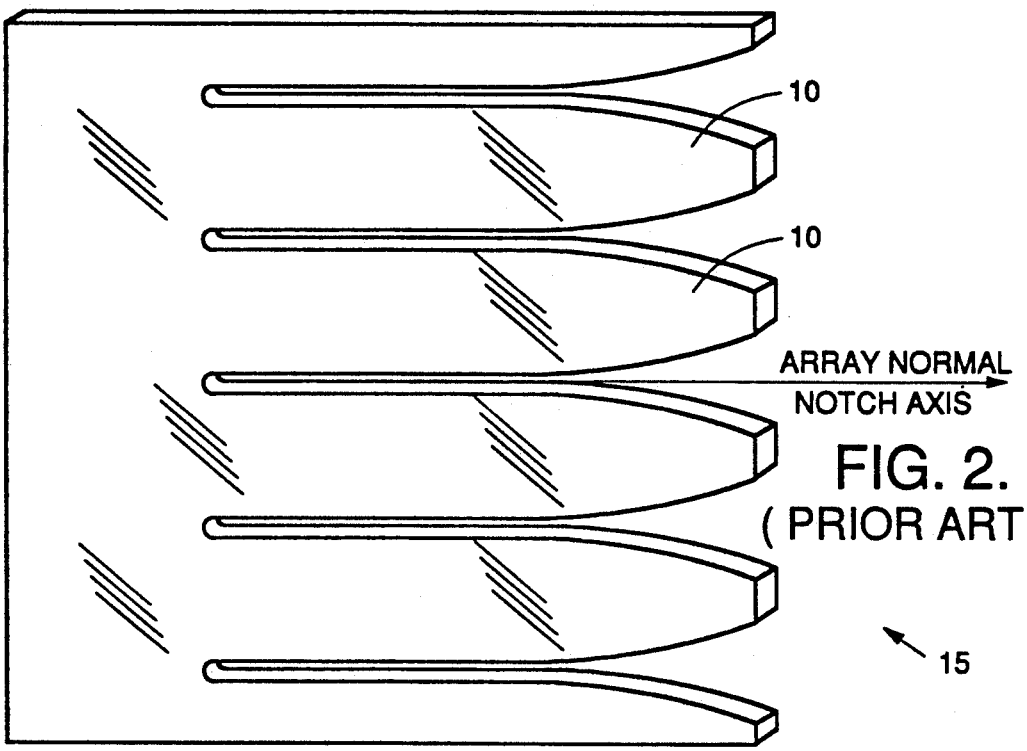
FIG. 2. ( PRIOR ART )
FIG. 2 shows a conventional array of notch radiators.

FIG. 2 shows a conventional array 15 of flared notch radiating elements 10 shown in FIG. 1. As is seen in FIG. 2, the axis of each of the flared notch radiating elements 10 is collinear with an axis that is normal to the surface of the array 15.

Figure 3:
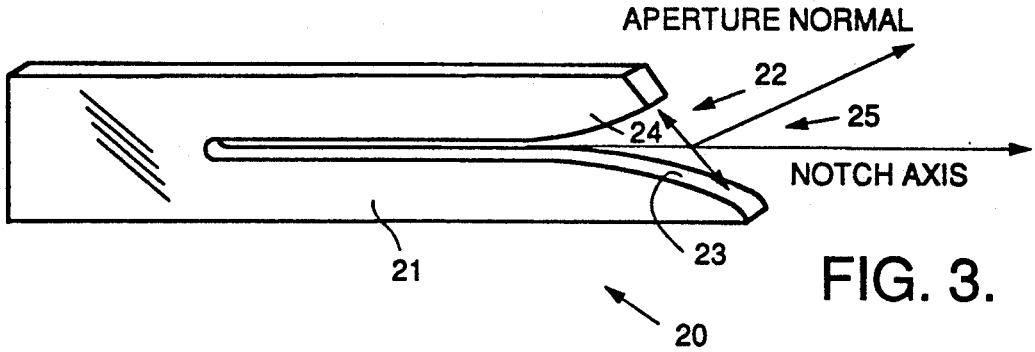
FIG. 3 shows an asymmetrical notch radiator made in accordance with the principles of the present invention.

FIG. 3 shows an asymmetrical notch radiating element 20 made in accordance with the principles of the present invention. The asymmetrical notch radiating element 20 shown in FIG. 3 is comprised of a substrate 21 into which a tapered slot 22 or notch 22 is cut. The direction of the axis of the tapered slot 22 can be caused to lie along any preselected axis and is not constrained to be collinear with the normal to the aperture of the asymmetrical notch radiating element 20.

More specifically, the asymmetrical notch radiating element 20 comprises the substrate 21 that may be made of metal or a metal-clad dielectric material, for example.

The tapered slot 22 is disposed int he substrate and has a lower flare 23 and an upper flare 24 that form an aperture 25 of the radiating element 20 and that each extend from the aperture 25 to a predetermined location within the radiating element 20 where the lower and upper flares 23, 24 meet. The direction of an axis of the tapered slot 22 lies along a preselected direction that is not collinear with the normal to the aperture 25 of the asymmetrical notch radiating element.

FIG. 4 shows an asymmetrical array 27 of asymmetrical notch radiating elements 20 shown in FIG. 3 made in accordance with the principles of the present invention.

The asymmetrical antenna array 27 comprises a plurality of asymmetrical notch radiating elements 20 as described above. Each of the plurality of asymmetrical notch radiating elements 20 is disposed with respect to the other asymmetrical notch radiating elements 20 such that the apertures 25 of each of the asymmetrical notch radiating elements 20 are substantially coplanar and are at an angle relative to the notch axis.

The boundaries of the slot 22 are chosen with the following constraints.

(1) The impedance of the slot 22 is controlled by the height of the slot 22, which is varied in order to transition from its slotline impedance to free space impedance. This impedance transition from a feed point impedance ($Z=100$ ohms) to free space impedance ($Z=377$ ohms) is chosen to be an asymmetric slotline taper. The initial cross section dimensions are chosen to have 100 ohm impedance while the final cross section dimensions are determined by the spacing of the asymmetrical notch radiating elements 20 of the asymmetrical array 27. The asymmetry is chosen to maintain peak gain for the transmit element pattern of the asymmetrical array 27 to be in a direction that is not normal to the surface of the asymmetrical array 25 (FIG. 4).

(2) The aperture plane of the asymmetrical array 27 is chosen based upon other system constraints, such as radar cross section requirements. These requirements define the specular structural scattering in a direction normal to the aperture. The aperture plane of the asymmetrical array 27 is chosen to provide scattering properties that meet these requirements. This is accomplished in a routine manner known to those skilled in the art.

The asymmetric flared notch radiating element 20 are used to fringe the transverse field lines into a plane that is rotated about the aperture normal. This permits control of the peak element gain location of the array 25. The asymmetrical notch radiating element 20 is designed for use in phased array antennas where reduced radar cross section and wide bandwidth are essential, or in conformal arrays, where the surface normal and array axis are not collinear. The design is intended to allow the axis of maximum gain of the asymmetrical notch radiator elements 20 to lie along an axis other that the normal to the face or front surface of the physical array 25.

The primary benefit of this approach is that the highly specular radar reflection from the antenna radiator elements 20, that lies along the normal to the array 25, no longer points in the same direction as the peak antenna gain. This allows the design of a low radar cross section (RCS) antenna array 25 that does not suffer poor gain due to its reduced cross section. The design is also beneficial in conformal array antennas, allowing the design freedom to mount radiator elements on an arbitrary surface, and still control the direction of peak gain of each element, thus allowing for alignment of all the element gain patterns.

Thus there has been described new and improved asymmetrically flared notch radiator elements and asymmetrical antenna arrays incorporating such radiator elements for use in phased array antennas. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. An asymmetrical notch radiating element comprising a substrate;

a tapered slot disposed in the substrate and having a lower flare and an upper flare that form an aperture of the radiating element and that each extend from the aperture to a predetermined location within the radiating element wherein the lower and upper flares meet, and wherein the direction of an axis of the tapered slot lies along a preselected direction that is not collinear with the normal to the aperture of the asymmetrical notch radiating element.

2. The asymmetrical notch radiating element of claim 1 wherein the substrate is comprised of metal.

3. The asymmetrical notch radiating element of claim 1 wherein the substrate is comprised of a metal-clad dielectric material.

4. An asymmetrical antenna array comprising:

a plurality of asymmetrical notch radiating elements, each of the notch elements comprising a substrate and a tapered slot disposed in the substrate and having a lower flare and an upper flare that form an aperture of the radiating element and that each extend from the aperture to a predetermined location within the radiating element wherein the lower and upper flares meet, wherein the direction of an axis of the tapered slot lies along a preselected direction that is not collinear with the normal to the aperture of the asymmetrical notch radiating element, and wherein each of the plurality of asymmetrical notch radiating elements is disposed with respect to the other asymmetrical notch radiating elements such that the apertures of each of the asymmetrical notch radiating elements are substantially coplanar.

5. The asymmetrical antenna array of claim 4 wherein the substrate is comprised of metal.

6. The asymmetrical antenna array of claim 4 wherein the substrate is comprised of a metal-clad dielectric material.

* * * * *